US009615179B2

(12) United States Patent
Greenberger

(10) Patent No.: US 9,615,179 B2
(45) Date of Patent: Apr. 4, 2017

(54) HEARING ASSISTANCE

(71) Applicant: Bose Corporation, Framingham, MA (US)

(72) Inventor: Hal Greenberger, Natick, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/835,929

(22) Filed: Aug. 26, 2015

(65) Prior Publication Data

US 2017/0064463 A1 Mar. 2, 2017

(51) Int. Cl.
*H04R 25/00* (2006.01)

(52) U.S. Cl.
CPC ..... *H04R 25/405* (2013.01); *H04R 25/407* (2013.01); *H04R 2225/61* (2013.01)

(58) Field of Classification Search
CPC H04R 25/405; H04R 25/407; H04R 2225/61; H04M 1/6066; H04M 1/05
See application file for complete search history.

(56) References Cited

U.S. PATENT DOCUMENTS 6,671,643 B2 * 12/2003 Kachler ..... H04R 25/30 381/61
8,760,284 B2 * 6/2014 Petersen ..... G08B 1/08 340/4.1
9,025,801 B2 * 5/2015 Rauch ..... H04R 25/453 381/312
9,131,321 B2 9/2015 Sabin
9,191,789 B2 * 11/2015 Pan ..... H04W 4/12
2003/0197620 A1 10/2003 Radousky
2006/0245611 A1 * 11/2006 Jorgensen ..... H04R 25/305 381/323
2009/0129616 A1 * 5/2009 Joeng ..... H01H 9/16 381/323
2009/0220926 A1 * 9/2009 Rechlis ..... G09B 19/04 434/185

(Continued)

FOREIGN PATENT DOCUMENTS

EP 2736273 A1 5/2014
WO 2004110098 A1 12/2004

OTHER PUBLICATIONS

J. Ramirez,, et al, Voice Activity Detection; Fundamentals and Speech Recognition System Robustness; Robust Speech Recognition and Understanding; ISBN 987-3-90213-08-0, pp. 460, I-Tech, Vienna, Austria, Jun. 2007; last downloaded from Internet on Mar. 4, 2016. http://cdn.intechopen.com/pdfs/104/InTech-Voice_activity_detection_fundamentals_and_speech_recognition_system_robustness.pdf.

(Continued)

*Primary Examiner* — Brenda Bernardi
(74) *Attorney, Agent, or Firm* — Brian M. Dingman; Dingman IP Law, PC

(57) ABSTRACT

A system and a method of indicating the reception of voice in a hearing assistance system that is constructed and arranged to assist a user to better hear the voice of another person. The hearing assistance system includes a detector that is capable of determining whether or not speech has been received by the hearing assistance system. In response to detecting the reception of the voice of another person by the hearing assistance system, the reception of the voice of another person by the hearing assistance system is visually indicated.

26 Claims, 8 Drawing Sheets

(56) References Cited

U.S. PATENT DOCUMENTS

| | | | | |
|---|---|---|---|---|
| 2009/0264161 | A1 | 10/2009 | Usher et al. | |
| 2012/0134522 | A1* | 5/2012 | Jenison | H04R 25/505 381/320 |
| 2014/0126733 | A1 | 5/2014 | Gauger, Jr. et al. | |
| 2014/0198934 | A1* | 7/2014 | Recker | H04R 25/407 381/313 |
| 2014/0236594 | A1* | 8/2014 | Clarke | G02B 27/017 704/233 |
| 2015/0036856 | A1* | 2/2015 | Pruthi | G06F 3/04842 381/317 |
| 2015/0163606 | A1* | 6/2015 | Halverson | H04R 25/305 381/322 |
| 2015/0230026 | A1 | 8/2015 | Eichfeld et al. | |
| 2016/0055371 | A1* | 2/2016 | Wu | H04L 67/306 382/118 |

OTHER PUBLICATIONS

The International Search Report and the Written Opinion of the International Searching Authority mailed on Nov. 21, 2016 for corresponding PCT Application No. PCT/US2016/048557.

* cited by examiner

HEARING ASSISTANCE

BACKGROUND

This disclosure relates to a system and method to assist people to better hear the voices of others.

When a user of earphones wears them in public, the social information broadcast to others is that the person wearing them is tuned into their own world and is not tuned into to the outside world. Hearing assist devices that look like existing earphones may broadcast the same social message, which is the opposite of what is intended. When a user wears a hearing assist device (and is operating it in hearing assist mode), the user wants to be connected to the outside world. It is desirable for these devices to broadcast a social message that the user in engaged with the outside world, not tuned out to it.

SUMMARY

This disclosure in part addresses the social aspect of using a device that looks like existing earphones for a hearing assist device. An active indicator is used to provide information that the user of a hearing assist device is not "tuned out" to a person who wishes to interact with the user. The indicator can take many forms. One form would be an active visual indicator to signal that the wearer is engaged or not with the outside world (say via a red or green light emitting diode (LED)). However, a problem with such an indicator could be that the meaning of the LED may not be apparent to the person interacting with the wearer. Accordingly, in another form a voice activity detector is operably coupled to the output of a hearing assistance device microphone array, and a visual indicator on the device is lit when voice is detected in the array output. The microphone array could be directional but need not be. When the device is in hearing assist mode, the indicator is active and it lights in some manner (a soft green glow, for example) when the voice of a person other than the user is detected. The indicator is visible to the other person (the speaker) and is tied to voice (rather than other sounds), so the speaker knows that their voice is detected. The indicator may have a narrow field of view such that it is visible only over a limited viewing angle. A narrow field of view light emitting diode (LED) may be used for this. In one non-limiting example the intensity of the glow of the indicator could be modulated as the talker speaks, or not. The indicator thus gives direct feedback to the talker that the device has heard the talker.

The user can in one example also switch off the indicator, for example when they wish to listen to their own content and not to the outside world, or if for some reason the user does not like the idea of the indicator.

The indicator is not tied to the reception of sound. Rather, it is specifically tied to indicating whether or not speech has been identified in the received sound signal. There can also be directional selectivity of the indicator. This directional selectivity should match the directional microphone array directionality that is feeding audio signals to the user. By using the microphone array output signal (after it has been beamformed), which is the same signal presented to the user's ears, as input to a voice activity detector, the indicator will also track any changes in array directivity that may occur dynamically with use. Alternatively, each individual ear signal could be used, or one ear signal could be used. Or a second beam could be formed that has the same directivity as the combined individual beams. There could be a separate voice activity detector on each ear signal, with their outputs logically OR'd, so that speech was detected and the detection indicated on either one of or both ears. Or, a separate directional beam could be formed that matched the combined directivity of each ear (at least approximately), and then detect voice on that output.

By having a modulated indicator, the power consumed by the indicator (which may be an LED) can be reduced because the indicator is only driven when speech in the region in front of the user is detected.

A benefit of the disclosure is that it gives direct feedback to a talker in front of a user of a hearing assist device that the device has heard the person speaking.

All examples and features mentioned below can be combined in any technically possible way.

In one aspect, a method of indicating the reception of voice in a hearing assistance system that comprises a detector that is capable of determining whether or not speech has been received by the hearing assistance system, where the hearing assistance system is constructed and arranged to assist a user to better hear the voice of another person, includes using the detector to detect the reception of the voice of another person by the hearing assistance system and in response to detecting the reception of the voice of another person by the hearing assistance system, visually indicating the reception of the voice of another person by the hearing assistance system.

Embodiments may include one of the following features, or any combination thereof. Visually indicating the reception of voice can include changing a state of a light source, which could be accomplished by turning the light source on, or changing the brightness of the light source, for example. The brightness of the light source may be increased when the voice of another person is detected. The light source may comprise a light emitting diode. Visually indicating may be accomplished with a visual indicator that is capable of being seen by the person whose voice was detected.

The hearing assistance system may further comprise a directional microphone array with an output, and the detector may comprise a voice activity detector that is operably coupled to the microphone array output. Visually indicating the reception of the voice of another person by the hearing assistance system may comprise visually indicating the reception of the voice of another person by the hearing assistance system when the voice is received within a first active sound reception angle, but not visually indicating the reception of the voice of another person by the hearing assistance system when the voice is received outside of the first active sound reception angle. The first active sound reception angle may encompass no more than 180 degrees, or may encompass no more than 120 degrees, or another smaller predetermined angle. Visually indicating the reception of the voice of another person by the hearing assistance system may further comprise also visually indicating the reception of the voice of another person by the hearing assistance system when the voice is received within a second active sound reception angle that is different than the first active sound reception angle, but not visually indicating the reception of the voice of another person by the hearing assistance system when the voice is received outside of the first or second active sound reception angles. For example, there may be a separate light source for each active sound reception angle.

In another aspect, a hearing assistance system includes a detector that is capable of determining whether or not the voice of another person has been received by the hearing assistance system, and a visual indicator, responsive to the detector, that indicates the reception of the voice of another person by the hearing assistance system.

Embodiments may include one of the above and/or below features, or any combination thereof. The visual indicator may be a light source. A state of the light source may change to indicate the reception of the voice of another person by the hearing assistance system. For example, the light source can be turned on to indicate the reception of the voice of another person by the hearing assistance system. Or, the brightness of the light source can be increased to indicate the reception of the voice of another person by the hearing assistance system. The light source may comprise a light emitting diode. The visual indicator may be capable of being seen by the person whose voice was detected.

The hearing assistance system may further comprise a directional microphone array with an output, and the detector may comprise a voice activity detector that is operably coupled to the microphone array output. The visual indicator may visually indicate the reception of the voice of another person by the hearing assistance system when the voice is received within a first active sound reception angle, but not visually indicate the reception of the voice of another person by the hearing assistance system when the voice is received outside of the first active sound reception angle. The first active sound reception angle may encompass no more than 180 degrees, or no more than 120 degrees, or another smaller predetermined angle. The visual indicator may also visually indicate the reception of the voice of another person by the hearing assistance system when the voice is received within a second active sound reception angle that is different than the first active sound reception angle, but not visually indicate the reception of the voice of another person by the hearing assistance system when the voice is received outside of the first or second active sound reception angles. For example, there may be a separate light source for each active sound reception angle.

DETAILED DESCRIPTION

Figure 1:
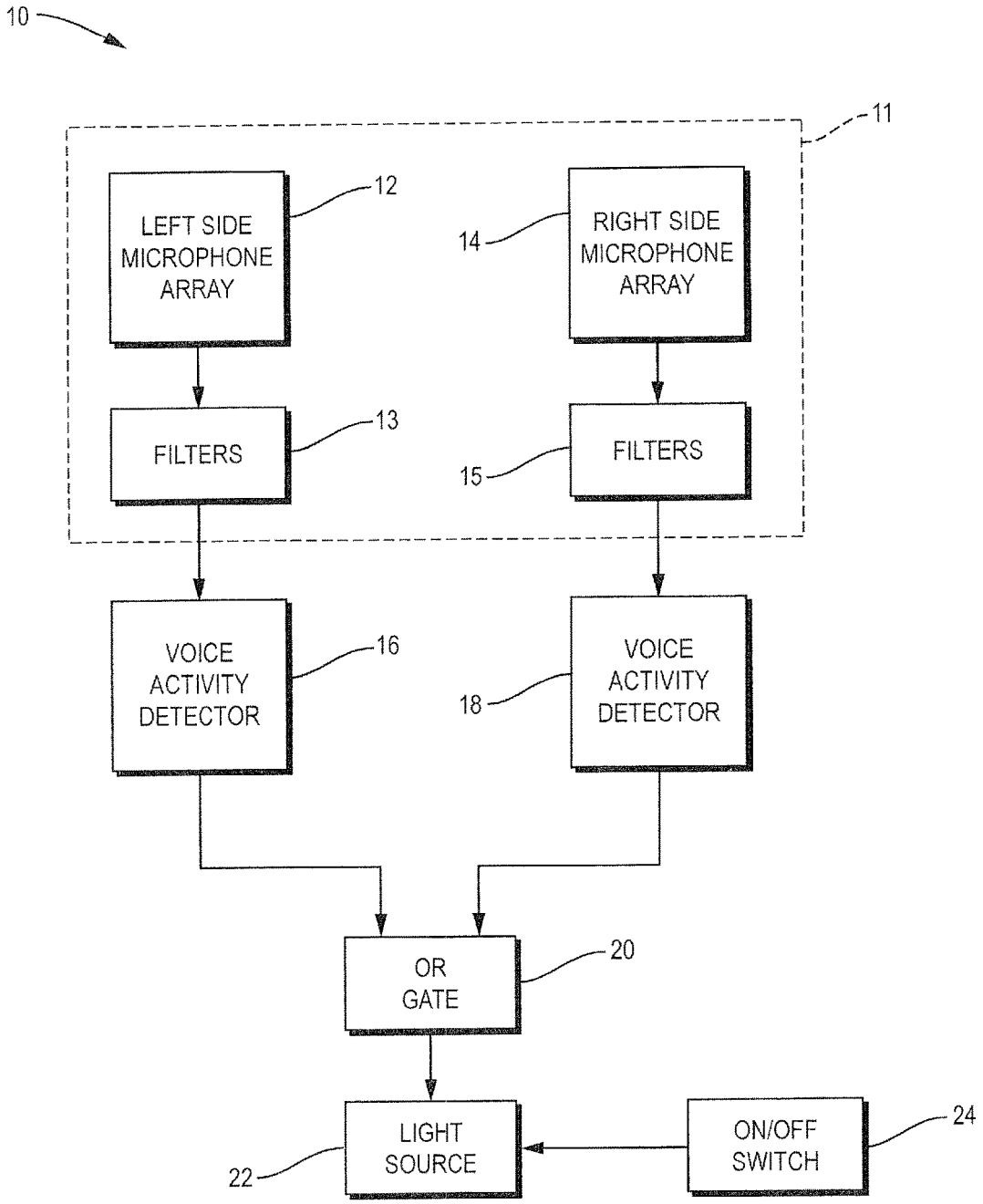
FIG. 1 is a schematic block diagram of a hearing assistance system that can also be used to accomplish methods described herein.
Figure 2:
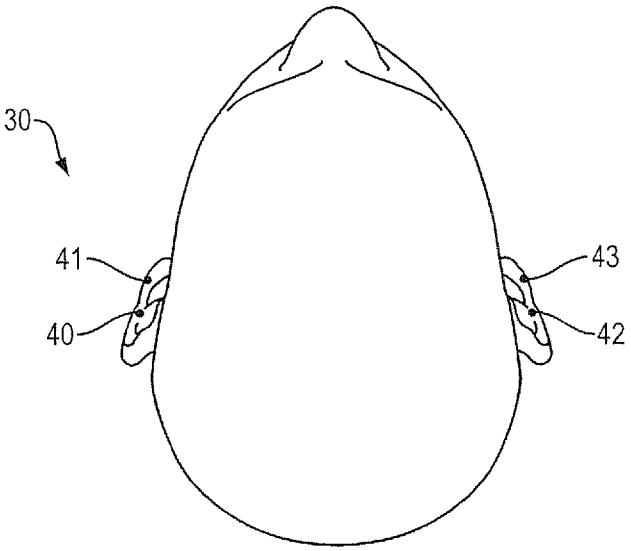
FIG. 2 schematically illustrates an example left and right two-element array layout for a conversation assistance system, where the microphones (illustrated as solid dots) are located next to the ears and are spaced apart by about 17.4 mm.

Conversation assistance devices aim to make conversations more intelligible and easier to understand. These devices aim to reduce unwanted background noise and reverberation. Conversation assistance devices can accomplish beamforming using a head-mounted microphone array. Beamforming may be time invariant or time varying. It may be linear or non-linear. Application of beamforming to conversation assistance is, in general, known. Improving the intelligibility of the speech of others with directional microphone arrays, for example, is known.

A conversation assistance device that can be used in the hearing assistance system and method of the present disclosure is typically either worn by the user (e.g., as a headset), or carried by the user (e.g., a modified smartphone case). The conversation assistance device includes one, and preferably more than one, microphone. There is typically but not necessarily one or more microphone arrays. There could be a single sided microphone array (i.e., an array of two or more microphones on only one side of the head) or a two sided microphone array (i.e., an array that uses at least one microphone on each side of the head). The conversation assistance device microphone array(s) are preferably directional. The hearing assistance system includes a visual indication of the reception of voice by the conversation assistance device. When the microphone array(s) are directional, this visual indication is preferably tied to the directionality, so that a third party who is talking to the user of the hearing assistance system and whose voice has been detected, is able to see the visual indicator.

A benefit of the disclosure is that it gives direct feedback to a talker in front of a user of a hearing or conversation assist device, that the device has heard the person speaking.

Elements of some of the figures are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in a block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

FIG. 1 illustrates one non-limiting example of hearing assistance system 10 according to the present disclosure. Hearing assistance system 10 assists a user to better hear the voice of another person. Hearing assistance system 10 includes hearing or conversation assistance device 11 that comprises a two-sided microphone array comprising left side microphone array 12 and right side microphone array 14. Hearing assistance device 11 further includes filters 13 for the left side array and filters 15 for the right side array. Generally, each microphone array 12, 14, includes at least two spaced microphones. This disclosure, however, is not limited to any particular quantity of or physical arrangement of microphones. More specifically, this disclosure is not limited to having a two-sided array. There could be a single array of microphones. The outputs of filter arrays 13 and 15 are the left and right ear output signals that are played back to the user through electroacoustic transduction. For a conversation enhancement system, the playback system can comprise earphones/headphones. The headphones may be over the ear or on the ear. The headphones may also be in the ear. Other sound reproduction devices may have the form of an ear bud that rests against the opening of the ear canal. Other devices may seal to the ear canal, or may be inserted into the ear canal. Some devices may be more accurately described as hearing devices or hearing aids.

Hearing assistance device 11 may be of a type generally known in the art. Non-limiting examples of such a hearing assistance device are disclosed in U.S. patent application Ser. No. 14/618,889 entitled "Conversation Assistance System" filed on Feb. 10, 2015, the entire disclosure of which is incorporated herein by reference.

Hearing assistance device 11 can define one, or more than one, active sound reception (horizontal or azimuthal) angle, or angle ranges. When a voice signal is received from within an active sound reception angle, there is a visual indication of the reception of voice. When voice is received outside of an active sound reception angle, there is no visual indication of the reception of voice. For example, hearing assistance device 11 can be configured to accept sound over a predetermined angle of arbitrary extent. For example, +−30, +−60, or other angles as desired. The extent of the active sound reception angle may vary with frequency. In non-limiting examples the active sound reception angle can be, e.g., +/−30 degrees or +/−60 degrees or +/−90 degrees of the user's forward facing direction. In other cases hearing assistance device 11 can be configured to define at least two separate active sound reception angles, where voice signals picked up in an active sound reception angle are visually indicated and voice signals outside of an active sound reception angle are not indicated. The active sound reception angles would most likely be non-overlapping, but could overlap. For example hearing assistance device 11 could be configured to detect sound in azimuthal bands that are generally to the front, left and right of the user, which may be advantageous when the user is talking to others while sitting at a conference table, for example. This disclosure is not limited to any particular sound reception angle, or any quantity of or arrangement of sound reception angles of the hearing assistance system.

In the present hearing assistance system 10, the left and right ear output signals from hearing assistance device 11 are each fed to a voice activity detector (VAD), 16 and 18, respectively. Voice activity detectors 16 and 18 are configured to determine whether or not the voice of another person has been received by the respective microphone array of the hearing assistance device 11. Voice activity detectors and voice activity detection are generally known in the art. Voice activity detectors can be an integral part of different speech communication systems such as audio conferencing, speech recognition and hands-free telephony, for example. The outputs of VADs 16 and 18 are provided to a logical OR gate 20. OR gate 20 will determine if either one of or both of VADs 16 and 18 have detected a voice signal. Alternatively, a single VAD could be used, which may save cost, processing, and power. A single VAD could be input with the combined left and right ear microphone outputs, or a single VAD could be used on a single ear output at a lower portion of the frequency range where each ear's directivity is approximately the same.

When the voice of another person is detected, a visual indicator is used to notify the speaker (and anyone else who can see the particular visual indicator) that the speaker's speech has been received by hearing assistance system 10. In the present case, the visual indictor is accomplished with one or more light sources 22. The light sources can be LEDs or other light emitting devices, or can be other light sources. The visual indicator could be a portion of a display. Visual indicators other than light sources could be used, such as a reflective display, an E Ink display, or any other type of now known or later developed visual indicator. The visible angle of the light source could be controlled with an optically polarized lens or film such that only talkers substantially on-axis would see the indicator. In one non-limiting example properties of the polarized lens or film could be selected to match that of the directional microphone array.

Preferably, a state of a light source is changed so as to indicate the reception of the voice of another person by hearing assistance system 10. For example, the light source can be turned on to indicate the reception of the voice of another person by hearing assistance system 10. In another example, the brightness of the light source is changed (e.g., increased) to indicate the reception of the voice of another person by hearing assistance system 10. In another example the color of the light source can be modulated to indicate the reception of the voice of another person by hearing assistance system 10; this can be accomplished in one example using multicolor LEDs.

For example, a light source could be one or more LEDs mounted on a headset worn by the user. When the device is in hearing assist mode an indicator is active and it lights in some manner (a soft green glow, for example) when voice is detected in an output of hearing assistance device 11. The indicator is tied to voice, not sound, so the speaker will know that his/her voice was detected. This can be conveyed by changing a state of the light source, for example by modulating the intensity of the glow as the person speaks or not. A modulated indicator will also save battery power because the power consumed by the light(s) is reduced since the light is only driven when speech in an active sound reception angle is detected.

The user can switch off the indicator, for example in order to listen to their own contents rather than the outside world, or if for some other reason the user does not desire to use the indicator. On/off switch 24 can be included for this purpose.

As described above, hearing assistance system 10 can have but need not have directional sound reception selectivity. Preferably but not necessarily, hearing assistance system 10 has matching visual indicator directional selectivity. For example, light source 22 can include two or more LEDs that are arranged on/around the earphones or on other physical structures of hearing assistance system 10 (e.g., a housing, or a smartphone case) such that they are generally aligned with the possible active sound reception angles of hearing assistance device 10. So, for example, light sources 22 could comprise a number of LEDs arranged on the device earphones, say with one facing forward, one facing left and one facing right. The LED that faced the direction of the speaker would light, or glow more brightly, when the speaker's voice was detected. This way, the speaker knows that the user is engaged with the outside world, and that the user hears the speaker's voice. By using the output of hearing assistance device 11, which can be but need not be the same signal that is presented to the user's ears, as the input to the voice activity detectors, the visual indicator can also track any changes in microphone array directivity that may occur dynamically with use.

Exemplary, non-limiting examples of microphone arrays, processing and array directivity are illustrated in FIGS. 2-7. Consider the four microphone array 30, FIG. 2, located on the head of a user. In one beamforming approach, the arrays are designed assuming the individual microphone elements are located in the free field. An array for the left ear is created by beamforming the two left microphones 40 and 41. The right ear array is created by beamforming the two right microphones 42 and 43. Well-established free field beamforming techniques for such simple, two-element arrays can create hypercardioid free-field reception patterns, for example. Hypercardioids are common in this context, as in the free-field they produce optimal talker to noise ratio (TNR) improvement for a two element array for an on-axis talker in the presence of diffuse noise.

Head-mounted arrays, especially those with high directivity, can be large and obtrusive. An alternative to head-mounted arrays are off-head microphone arrays, which for example can be placed on a table in front of the listener, or on the listener's torso, after which the directional signal is transmitted to an in-ear device commonly employing hearing-aid signal processing. Although these devices are less obtrusive, they lack a number of characteristics that can be present in binaural head mounted arrays. First these devices are typically monaural, transmitting the same signal to both ears. These signals are devoid of natural spatial cues and the associated intelligibility benefits of binaural hearing. Second, these devices may not provide sufficient directivity. Third, these devices do not rotate with the user's head and hence do not focus sound reception toward the user's visual focus. Also, the array design may not take into account the acoustic effects of the structure that the microphones are mounted to.

When used herein, two-sided beamforming of the arrays of microphones on the left and right sides of the head can utilize at least one (and preferably all) of the microphones on both sides of the head to create both the left- and right-ear audio signals. This arrangement may be termed a "two-sided array." Preferably but not necessarily the array comprises at least two microphones on each side of the head. Preferably but not necessarily the array also comprises at least one microphone in front of and/or behind the head. Other non-limiting examples of arrays that can be employed in the present disclosure are shown and described below. Two sided arrays can provide improved directionality performance compared to one sided arrays by increasing the number of elements that can be used and increasing the spacing of at least some of the individual elements relative to other elements (elements on opposite sides of the head will be spaced farther apart than elements on the same side of the head).

Figure 3:
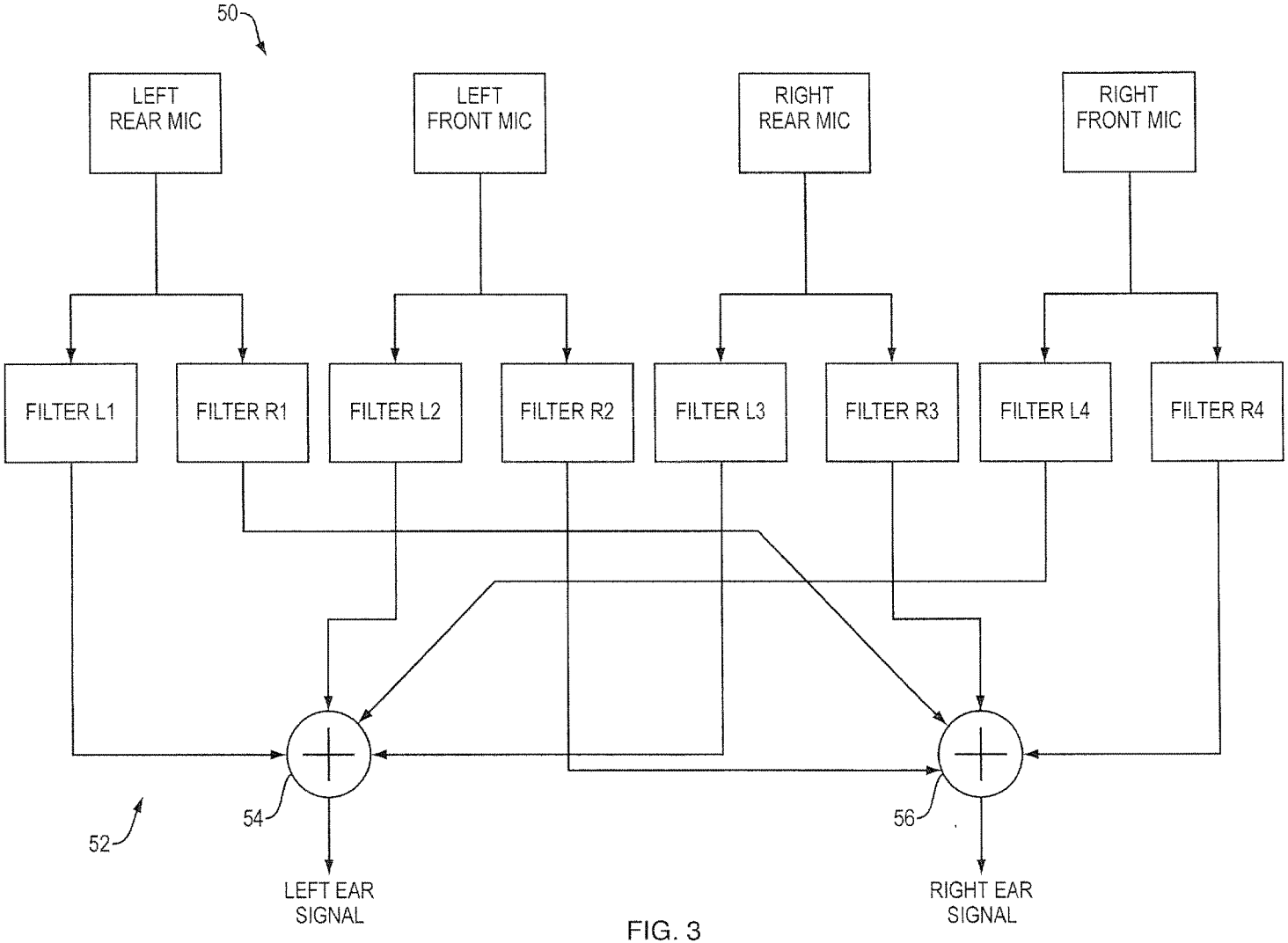
FIG. 3 is a simplified schematic block signal processing diagram for a system using a two-sided four-clement array such as that shown in FIG. 2.

Using all microphones in the array to create the audio signal for each ear can substantially increase the ability to meet design objectives when coupled with an array filter design process, discussed below. One possible design objective is for increased directivity. FIG. 3 is a simplified block signal-processing diagram 50 showing an arrangement of filters for such a two-sided array. The figure omits details such as A/Ds, D/As, amplifiers, non-linear signal processing functions such as dynamic range limiters, user interface controls and other aspects which would be apparent to one skilled in the art. It should also be noted that all of the signal processing for the conversation enhancement device including the signal processing shown in FIG. 3 (and signal processing omitted from the figure, including the individual microphone array filters, summers that sum the outputs of the individual array filters, equalization for each ear signal, non-linear signal processing such as dynamic range limiters and manual or automatic gain controls, etc.) may be performed by a single microprocessor, a DSP, ASIC, FPGA, or analog circuitry, or multiple or combinations of any of the above. Set of array filters 52 includes a filter for each microphone, for each of the left and right audio signals. The left ear audio signal is created by summing (using summer 54) the outputs of all four microphones filtered by filters L1, L2, L3 and L4, respectively. The right ear audio signal is created by summing (using summer 56) the outputs of all four microphones filtered by filters R1, R2, R3 and R4, respectively.

Figure 4:
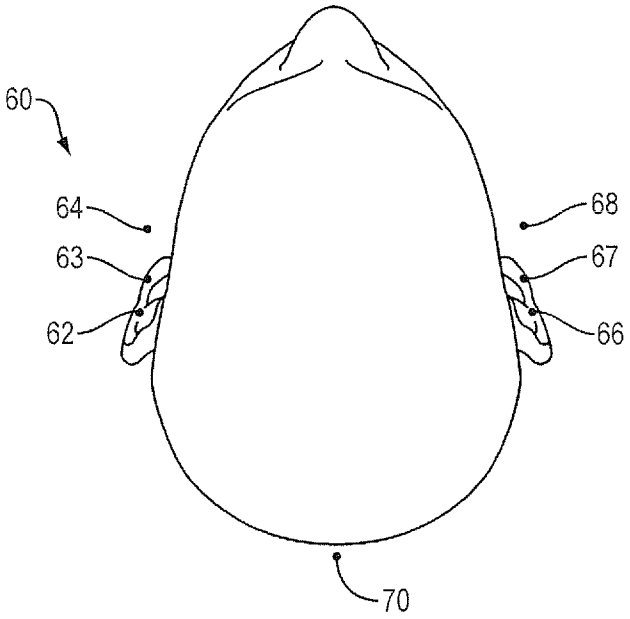
FIG. 4 illustrates one non-limiting microphone placement for a seven-element array.

Two-sided beamforming can be applied to arrays of any number of elements, or microphones. Consider an exemplary, non-limiting seven-element array 60 as shown in FIG. 4, with three elements on each side of the head and generally near each ear (microphones 62, 63 and 64 on the left side of the head and proximate the left ear and microphones 66, 67 and 68 on the right side of the head and proximate the right ear) and one 70 behind the head. Note that there can be two or more elements on each side of the head, and microphone 70 may not be present, or it may be located elsewhere spaced from the left and right-side arrays, such as in front of or on top of the head, or on the bridge of a pair of eyeglasses. These elements may but need not all lie generally in the same horizontal plane. Also, mics may be located vertically above one another.

Note that in the example of one-sided four element array, the two left microphones proximate to the left ear are beamformed to create the left ear audio signal and the two right microphones proximate to the right ear are used to create the right ear audio signal. Although this array is referred to as a four-element array since there is a total of four microphones, only microphones on one side of the head are beamformed to create an array for the respective side. This differs from two-sided beamforming, where at least one (and in some cases all) of the microphones on both sides of the head are beamformed together to create both the left and right ear audio signals.

Microphones on the left side of the head are too distantly spaced from microphone elements on the right side of the head for desirable array performance above approximately 1200 Hz, for an array that combines outputs of the left and right side elements. To avoid polar irregularities, referred to as "grating lobes" in the literature, at higher frequencies, one side of two-sided arrays can be effectively low-passed above approximately 1200 Hz. In one non-limiting example, below a low pass filter corner frequency of 1200 Hz, both sides of the head are beamformed, while above 1200 Hz, the array transitions to a single-sided beamformer for each ear. In order to preserve spatial cues (e.g., differences in interaural levels and phase (or equivalently, time)), the left-ear array uses only left-side microphones above 1200 Hz. Similarly, the right-ear array uses only right-side microphones above 1200 Hz. Each ear signal is formed from all array elements for frequencies below 1200 Hz. This bandwidth limitation can be implemented using the array filter design process, or can be implemented in other manners.

Two sided beamforming in a conversation enhancement system allows design of arrays with higher directivity than would otherwise be possible using single sided arrays. However, two sided arrays also can negatively impact spatial cues at lower frequencies where array elements on both sides of the head are used to form individual ear signals. This impact can be ameliorated by introduction of (optional) binaural beamforming. Note that binaural beamforming is not needed for a microphone array used solely for voice reception indication, but it does help humans determine the direction from which a voice was received.

Spatial cues, such as interaural level differences (ILDs) and interaural phase differences (IPDs), are desirable to maintain in a conversation assistance system for several reasons. First, the extent to which listeners perceive their audible environment as spatially natural depends on characteristics of spatial cues. Second, it is well known in the art that binaural hearing and its associated spatial cues increase speech intelligibility. Creating beneficial spatial cues in a conversation assistance system may thus enhance the perceived spatial naturalness of the system and provide additional intelligibility gain.

Binaural beamforming is a method that can be applied to address the above interaural issues, while still preserving the high directivity and TNR gain and lower WNG of two-sided bcamformed arrays. To accomplish this, binaural beamforming processes the microphone signals within the array to create specific polar ILDs and IPDs as heard by the user, and also attenuates all sound sources arriving from beyond a specified pass-angle, for example +/−45-degrees. To the user, a conversation assistance device utilizing binaural beamforming can provide two important benefits. First, the device can create a more natural and intelligible hearing assistance experience by reproducing more realistic ILDs and IPDs within the pass angle of the array. Second, the device can significantly attenuate sounds arriving outside of the pass angle. Other benefits are possible.

Figure 5A:
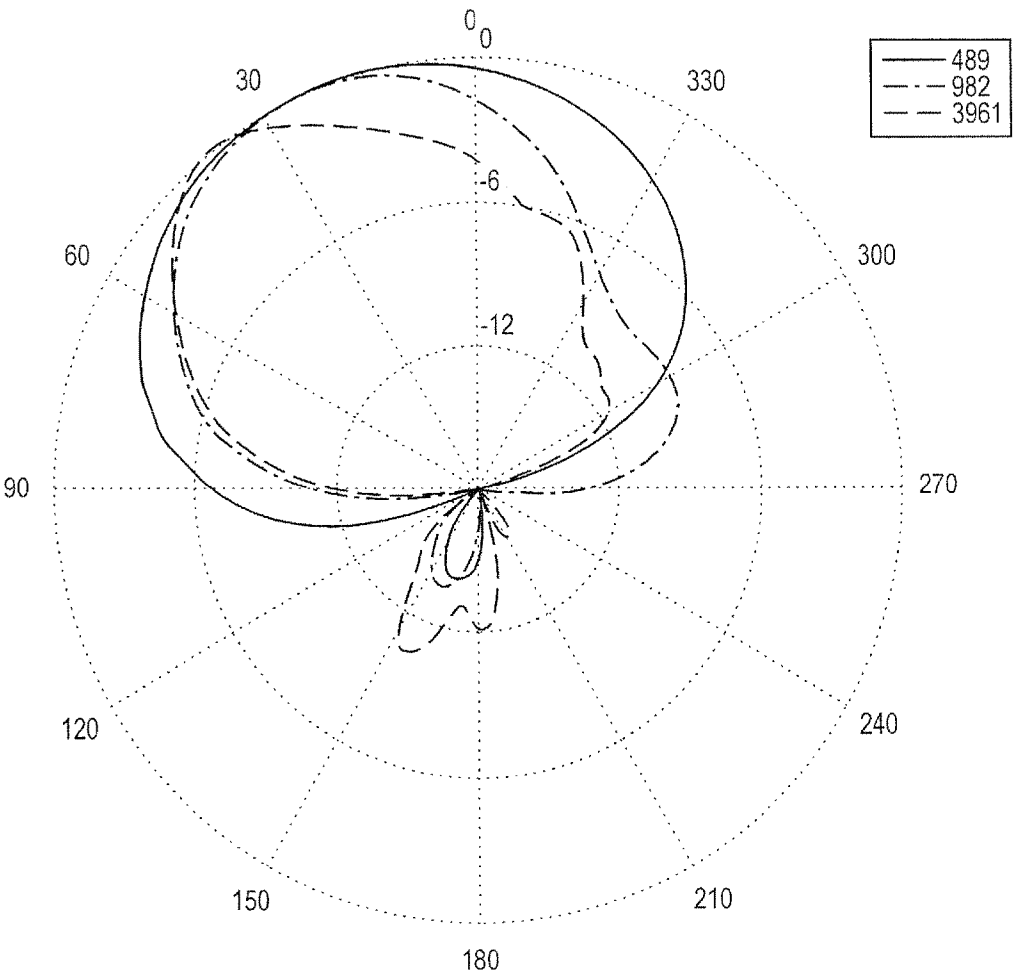
FIGS. 5A and 5B illustrate the left and right ear polar response of seven-element binaural array.
Figure 5B:
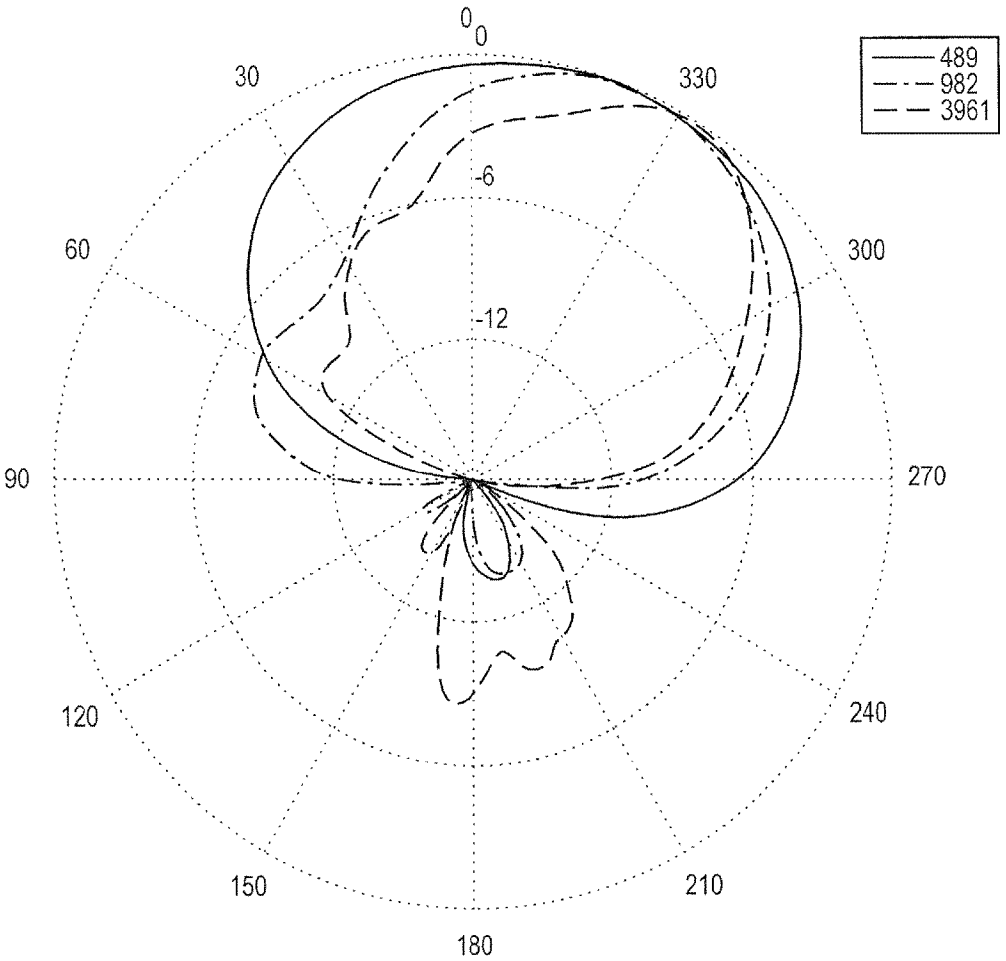

Given these specifications, array filters for both the left and right array microphone outputs can be created using the array filter design process. FIGS. 5A and 5B show examples of the resulting left ear and right ear binaural array polar response for the seven-element array of FIG. 4, each at the same three frequencies (489 Hz, 982 Hz and 3961 Hz). Observe the single main lobes for one ear beamformer. One could actually form multiple "sub" beams that approximately match the directivity of this one ear beamformer. For example, two or three separate beams could be constructed, where each individual sub-beam is narrower than the single main lobe but added together the sub-beams approximate the width of the ear beam (and could be slightly wider or narrower). If separate beams are being formed, they should match the overall directivity of the hearing assistance system considering both ears. The individual sub-beams need not be binaural; they can be monophonic. In such a system, there would be the left and right ear beams, and then however many sub beams formed.

Each sub beam output could be fed to a VAD, with visual indicators associated with each sub beam. When voice is detected in a sub beam, its associated indicator is activated. Such a system can differentiate among multiple speakers that may be in front of a user, such that each user is provided feedback associated with whether or not their speech was presented to the user by the hearing assistance system.

The main lobe need not be steered in the forward direction. Other target angles are possible. A main lobe could be steered toward the user's immediate left or right side in order to hear a talker sitting directly next to the user. This main lobe could recreate binaural cues corresponding to a talker at the left or right of the user, and also still reject sounds from other angles. With an array placed on a table in front of the user, a talker 90-degrees to the left of the user may not be 90-degrees to the left of the array (e.g., it may be at about −135 degrees). Accordingly the spatial target must be warped from purely binaural. In this example, the target binaural specification of the array for a source at −135 degrees should recreate ILDs and IPDs associated with a talker at 90-degrees to the left of the user.

Figure 6:
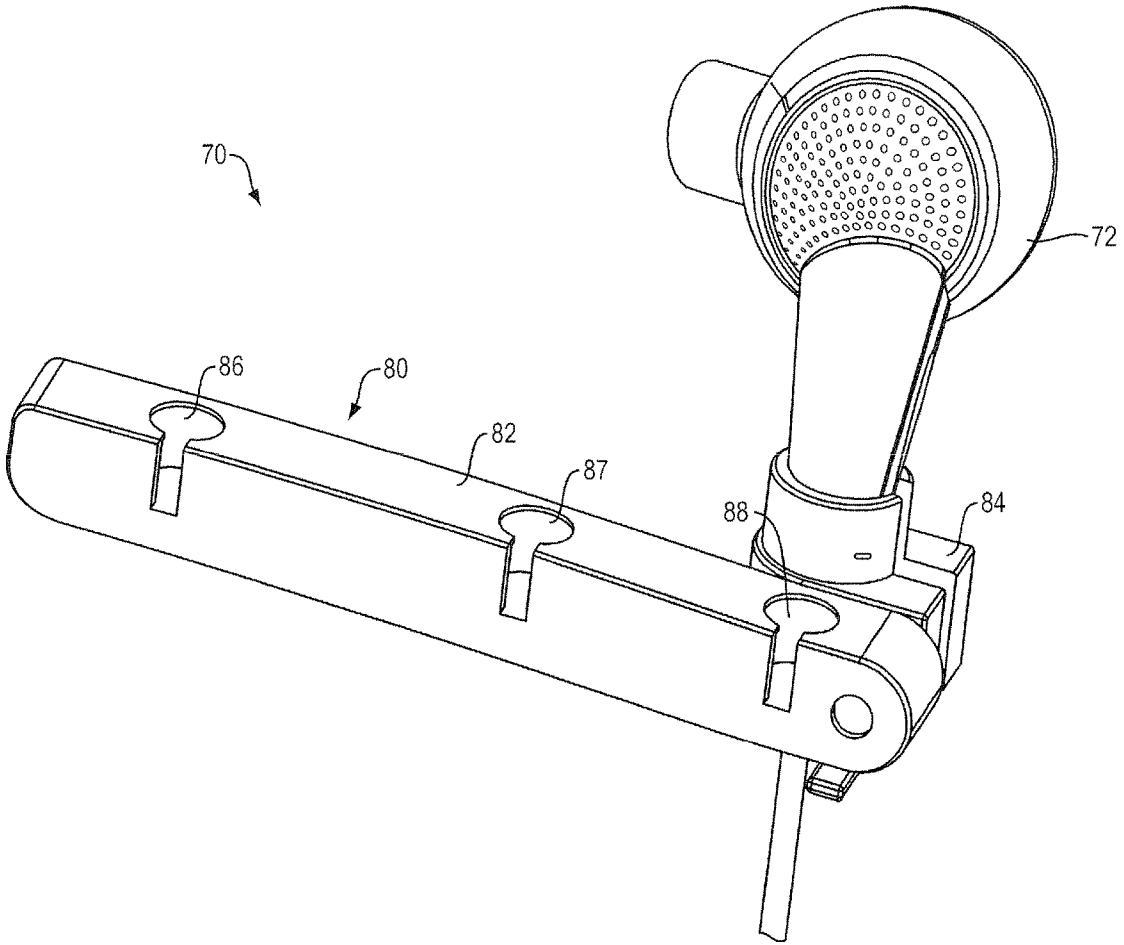
FIG. 6 illustrates a conversation assistance system with the elements that are on the sides of the head carried by an car bud.

One non-limiting example illustrating one of the numerous possible ways of implementing the conversation assistance system is to affix the microphone elements of the left side of the array to a left eyeglasses temple portion and the right side elements to the right temple portion. Another possibility is shown in FIG. 6, where assembly 70 adds the arrays to an ear bud 72. Housing 80 is carried by adapter 84 that fits to the car bud. Cavities 86, 87 and 88 each carry one of three microphone elements of a six-element array. A seventh element (if included) could be carried by a nape band, or by a head band, for example. Or it could be carried on the bridge of eyeglasses. A larger display on the ear bud (e.g. larger than a single LED) could be user-configurable; the user could select an icon to represent the "available" and "unavailable" states through a customization interface (e.g. a smartphone App). The user could also create their own icons through an App. A more socially desirable visual effect may be to illuminate an earbud indirectly, for example through translucent silicone comprising the ear tip. This would present a more pleasing "back lit" display. Patterns to the light could be added by selectively molding shapes or objects into the silicone mixture, which may only be evident when backlighting is active. The user could choose the lighting scheme and responsiveness of the system, e.g., via an App.

Figure 7:
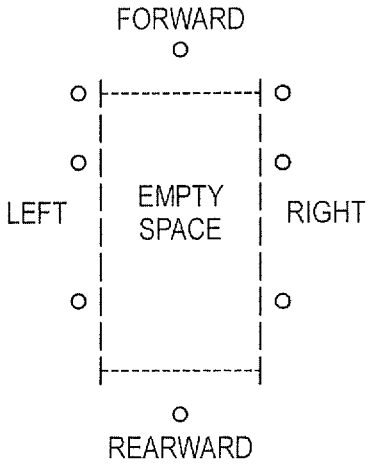
FIG. 7 is an example of an array that can be used in the conversation assistance system.

The concepts described above with regard to head mounted microphone arrays can be applied to microphone arrays used with a hearing assistance device where the array is not placed on the user's head. One example of an array that is not mounted on the head and can be (but need not be) used in the two-sided beamforming approach described herein, is shown in FIG. 7, where microphones are indicated by a small circle. This example includes eight microphones with three on each of the left and right sides, and one each on the forward and rearward side. The "empty space" is devoid of microphones but need not be empty of other objects, and indeed may include an object (such as a smartphone case) that carries one or more of the microphones (e.g., around its perimeter) and/or other components of the conversation assistance system. Should this microphone array be placed on a table, the rearward mic would normally face the user, while the forward mic would most likely face in the visually forward direction. The voice activity signaling techniques described above apply equally to an off-head hearing assistance device.

Using all microphones for each left and right ear signal can provide improved performance compared to a line array. In the two-sided beamforming aspect of a conversation assistance system, all or some of the microphones can be used for each of the left and right ear signal, and the manner in which the microphones are used can be frequency dependent. In the example of FIG. 7 (and presuming the space is about the size of a typical smartphone (such as about 15×7 cm)), the microphones on the left side of the array may be too distant from right side microphones for desirable performance above about 4 kHz. In other words, the left and right side microphones when combined would cause spatial aliasing above this frequency. Thus, the left ear signal can use only left-side, front, and back microphones above this frequency, and the right car signal can use only right-side, front, and back microphones above this frequency. The maximum desired crossover frequency is a function of the distance between the left side and right side microphones, and the geometry of any object that may be between the left and right side arrays. However, a lower crossover frequency may be chosen, for example if a wider polar receive pattern is desired. Since a cell phone case is narrower than the space between the ears of a typical user, the crossover frequency is higher than it is for a head mounted device. However, non-head worn devices are not limited in their physical size, and may have wider or narrower microphone spacing than shown for the device in FIG. 7.

Microphone positions that differ from those shown in FIG. 7 may perform better depending on the embodiment and spatial target. Other microphone configurations can be used, however. For example, placing pairs of microphones adjacent to each of the four corners of the space in FIG. 7 can provide better steering control of the main lobes at high frequency. Placement of microphones determines the acoustic degrees of freedom for array processing. For a given number of microphones, if directional performance (e.g., preservation of binaural cues) is more important at some angles of orientation instead of others, placing more microphones along one axis instead of another may yield more desirable performance. The array in FIG. 7 biases array performance for the forward looking direction, for example. Alternatively, different microphone placement can bias array performance for multiple off-axis angles. The quantity of microphones and their positions can be varied. Also, the number of microphones used to create each of the left and right ear signals can be varied. The "space" need not be rectangular. More generally, an optimal microphone arrangement for an array can be determined by testing all possible microphone spacings given the physical constraints of the device(s) that carry the array. WNG can be considered, particularly at low frequencies.

Another non-limiting example of the conversation assistance system involves use of the system as a hearing aid. A remote array (e.g., one built into a portable object such as a cell phone/smartphone or cell phone/smartphone case, or an eyeglass case) can be placed close to the user. Signal processing accomplished by the system accomplishes both microphone array processing and signal processing to compensate for a hearing deficit. Such a system may but need not include a user interface (UI) that allows the user to implement different prescriptive processing. For example the user may want to use different prescriptive processing if the array processing changes, or if there is no array processing. Users may desire to be able to adjust the prescriptive processing based on characteristics of the environment (e.g., the ambient noise level). A mobile device for hearing assistance device control is disclosed in U.S. patent application Ser. No. 14/258,825, filed on Apr. 14, 2014, entitled "Hearing Assistance Device Control", the disclosure of which is incorporated herein in its entirety.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A method of indicating the reception of voice in a hearing assistance system that is constructed and arranged to assist a user to better hear the voice of another person, the method comprising:

using a detector that is capable of determining whether or not speech has been received by the hearing assistance system to detect the reception of the voice of another person by the hearing assistance system; and in response to detecting the reception of the voice of another person by the hearing assistance system, visually indicating the reception of the voice of another person by the hearing assistance system, wherein visually indicating comprises: visually indicating, with a first visual indicator that is capable of being seen by the person whose voice was detected, the reception of the voice of another person by the hearing assistance system when the voice is received within a first active sound reception angle; and visually indicating, with a second visual indicator that is capable of being seen by the person whose voice was detected, the reception of the voice of another person by the hearing assistance system when the voice is received within a second active sound reception angle that is different than the first active sound reception angle.

2. The method of claim 1 wherein visually indicating comprises changing a state of a light source.

3. The method of claim 2 wherein changing a state of a light source comprises turning the light source on.

4. The method of claim 2 wherein the light source comprises a light emitting diode.

5. The method of claim 2 wherein changing a state of a light source comprises changing the brightness of the light source.

6. The method of claim 5 wherein the brightness of the light source is increased when the voice of another person is detected.

7. The method of claim 1 wherein the hearing assistance system further comprises a directional microphone array with an output, and wherein the detector comprises a voice activity detector that is operably coupled to the microphone array output.

8. The method of claim 7 wherein visually indicating the reception of the voice of another person by the hearing assistance system comprises not visually indicating the reception of the voice of another person by the first visual indicator of the hearing assistance system when the voice is received outside of the first active sound reception angle.

9. The method of claim 8 wherein the first active sound reception angle encompasses no more than 180 degrees.

10. The method of claim 9 wherein the first active sound reception angle encompasses no more than 120 degrees.

11. The method of claim 8 wherein visually indicating the reception of the voice of another person by the hearing assistance system further comprises not visually indicating the reception of the voice of another person by the hearing assistance system when the voice is received outside of the first or second active sound reception angles.

12. The method of claim 11 wherein the first and second visual indicators comprise separate light sources.

13. A hearing assistance system that assists a user to better hear the voice of another person, comprising:

a detector that is capable of determining whether or not the voice of another person has been received by the hearing assistance system; and a visual indicator system, responsive to the detector, that indicates the reception of the voice of another person by the hearing assistance system, wherein the visual indicator system comprises: a first visual indicator that is capable of being seen by the person whose voice was detected, when the voice is received within a first active sound reception angle; and a second visual indicator that is capable of being seen by the person whose voice was detected, when the voice is received within a second active sound reception angle that is different than the first active sound reception angle.

14. The hearing assistance system of claim 13 wherein the visual indicator comprises a light source.

15. The hearing assistance system of claim 14 wherein a state of the light source is changed to indicate the reception of the voice of another person by the hearing assistance system.

16. The hearing assistance system of claim 14 wherein the light source is turned on to indicate the reception of the voice of another person by the hearing assistance system.

17. The hearing assistance system of claim 14 wherein the light source comprises a light emitting diode.

18. The hearing assistance system of claim 14 wherein the brightness of the light source is increased to indicate the reception of the voice of another person by the hearing assistance system.

19. The hearing assistance system of claim 13 further comprising a directional microphone array with an output, and wherein the detector comprises a voice activity detector that is operably coupled to the microphone array output.

20. The hearing assistance system of claim 19 wherein the visual indicator system does not visually indicate the reception of the voice of another person by the first visual indicator when the voice is received outside of the first active sound reception angle.

21. The hearing assistance system of claim 20 wherein the first active sound reception angle encompasses no more than 180 degrees.

22. The hearing assistance system of claim 21 wherein the first active sound reception angle encompasses no more than 120 degrees.

23. The hearing assistance system of claim 20 wherein the visual indicator system does not visually indicate the reception of the voice of another person by the hearing assistance system when the voice is received outside of the first or second active sound reception angles.

24. The hearing assistance system of claim 23 wherein the first and second visual indicators comprise separate light sources.

25. A method of indicating the reception of voice in a hearing assistance system that is constructed and arranged to assist a user to better hear the voice of another person, the method comprising:

using a detector that is capable of determining whether or not speech has been received by the hearing assistance system to detect the reception of the voice of another person by the hearing assistance system;

in response to detecting the reception of the voice of another person by the hearing assistance system, visually indicating the reception of the voice of another person by the hearing assistance system;

wherein the hearing assistance system further comprises a directional microphone array with an output, and wherein the detector comprises a voice activity detector that is operably coupled to the microphone array output;

wherein visually indicating the reception of the voice of another person by the hearing assistance system comprises visually indicating the reception of the voice of another person by the hearing assistance system when the voice is received within a first active sound reception angle, but not visually indicating the reception of the voice of another person by the hearing assistance system when the voice is received outside of the first active sound reception angle;

wherein visually indicating the reception of the voice of another person by the hearing assistance system further comprises also visually indicating the reception of the voice of another person by the hearing assistance system when the voice is received within a second active sound reception angle that is different than the first active sound reception angle, but not visually indicating the reception of the voice of another person by the hearing assistance system when the voice is received outside of the first or second active sound reception angles; and wherein visually indicating is accomplished with a light source and there is a separate light source for each active sound reception angle.

26. A hearing assistance system that assists a user to better hear the voice of another person, comprising:

a detector that is capable of determining whether or not the voice of another person has been received by the hearing assistance system;

a visual indicator, responsive to the detector, that indicates the reception of the voice of another person by the hearing assistance system;

a directional microphone array with an output, and wherein the detector comprises a voice activity detector that is operably coupled to the microphone array output;

wherein the visual indicator visually indicates the reception of the voice of another person by the hearing assistance system when the voice is received within a first active sound reception angle, but does not visually indicate the reception of the voice of another person by the hearing assistance system when the voice is received outside of the first active sound reception angle;

wherein the visual indicator also visually indicates the reception of the voice of another person by the hearing assistance system when the voice is received within a second active sound reception angle that is different than the first active sound reception angle, but does not visually indicate the reception of the voice of another person by the hearing assistance system when the voice is received outside of the first or second active sound reception angles; and wherein the visual indicator comprises a separate light source for each active sound reception angle.

* * * * *